US009926724B2

(12) United States Patent
Kamin

(10) Patent No.: US 9,926,724 B2
(45) Date of Patent: Mar. 27, 2018

(54) SELF-LOCK MODULE

(71) Applicant: CompX International Inc., Greenville, SC (US)

(72) Inventor: John Y. Kamin, Taylors, SC (US)

(73) Assignee: CompX International Inc., Greenville, SC (US)

( * ) Notice: Subject to any disclaimer, the term of this patent is extended or adjusted under 35 U.S.C. 154(b) by 146 days.

(21) Appl. No.: 14/688,441

(22) Filed: Apr. 16, 2015

(65) Prior Publication Data

US 2015/0308152 A1 Oct. 29, 2015

Related U.S. Application Data

(60) Provisional application No. 61/983,526, filed on Apr. 24, 2014.

(51) Int. Cl.
*E05B 17/04* (2006.01)
*E05B 3/06* (2006.01)
(Continued)

(52) U.S. Cl.
CPC ..... *E05B 17/04* (2013.01); *E05B 3/065* (2013.01); *E05B 15/0013* (2013.01); *E05B 17/048* (2013.01); *E05B 63/0056* (2013.01); *E05C 1/08* (2013.01); *E05B 2009/047* (2013.01); *E05B 2015/041* (2013.01)

(58) Field of Classification Search
CPC ... E05B 3/00; E05B 3/06; E05B 3/065; E05B 3/08; E05B 9/10; E05B 2009/047; E05B 15/0103; E05B 15/04; E05B 2015/0403; E05B 2015/0406; E05B 2015/041; E05B 17/04; E05B 17/041
See application file for complete search history.

(56) References Cited

U.S. PATENT DOCUMENTS 2,249,272 A * 7/1941 Dey ..... E05B 3/065 292/348
2,256,710 A * 9/1941 Gowdy ..... E05B 3/065 292/357

(Continued)

*Primary Examiner* — Christopher J Boswell
(74) *Attorney, Agent, or Firm* — Dority & Manning, P.A.

(57) ABSTRACT

Disclosed are apparatus and corresponding methodology for the attachment of a self-contained module to any mechanical lock having a mating feature to accept it (in either of an OEM application or as a retrofit). The module enables a separate (preexisting) cam locking feature (components) to be associated with an existing mechanical lock by being fitted onto the back of the existing lock and then having the cam locking components attached to the module. In turn, the preexisting cam locking components may be fitted to the module aligned in any one of four positions (up, down, left, and right) on the back of the module for latching in any position in which the associated lock/cam strike may be installed. The cam locking components then function to allow a user to open an associated door or drawer, and when finished, slam it shut without having to rotate the lock back to a locked position. The self-contained module allows the cam locking components to be fitted to a standard, mechanical lock and still have the self-lock feature that is otherwise not available within the existing lock.

19 Claims, 5 Drawing Sheets

(51) Int. Cl.

| | |
|---|---|
| ***E05B 15/00*** | (2006.01) |
| ***E05B 63/00*** | (2006.01) |
| ***E05C 1/08*** | (2006.01) |
| *E05B 15/04* | (2006.01) |
| *E05B 9/04* | (2006.01) |

(56) References Cited

U.S. PATENT DOCUMENTS

| | | | | |
|---|---|---|---|---|
| 5,529,354 | A * | 6/1996 | Studt | E05B 3/065 292/163 |
| 5,666,833 | A * | 9/1997 | Gao | E05B 3/065 292/336.3 |
| 6,038,898 | A | 3/2000 | Cliff | |
| 6,474,118 | B2 | 11/2002 | Martinez | |
| 6,513,357 | B2 | 2/2003 | McCurry | |
| 6,869,116 | B2 * | 3/2005 | Dalsing | E05B 3/065 292/336.3 |
| 7,137,657 | B2 * | 11/2006 | Wu | E05B 15/02 292/336.3 |
| 7,686,357 | B2 * | 3/2010 | Engel | E05B 3/00 292/347 |
| 7,828,349 | B2 * | 11/2010 | Chen | E05B 3/065 292/347 |
| 7,900,978 | B2 * | 3/2011 | Zimmer | E05B 3/065 292/100 |
| 8,215,685 | B2 * | 7/2012 | Ellis | E05B 3/065 292/165 |
| 8,234,891 | B2 | 8/2012 | Dalton, Jr. et al. | |
| 8,403,376 | B2 | 3/2013 | Greiner et al. | |
| 2007/0257773 | A1 | 11/2007 | Hill et al. | |
| 2009/0132090 | A1 | 5/2009 | Kaczmarz et al. | |
| 2009/0146439 | A1 * | 6/2009 | Watts | E05B 3/065 292/350 |
| 2009/0315342 | A1 | 12/2009 | Dalton, Jr. et al. | |
| 2011/0074543 | A1 | 3/2011 | Kaczmarz et al. | |
| 2012/0248794 | A1 | 10/2012 | Dalton, Jr. et al. | |
| 2013/0192320 | A1 | 8/2013 | Dalton, Jr. et al. | |

* cited by examiner

SELF-LOCK MODULE

PRIORITY CLAIM

This application claims the benefit of previously filed U.S. Provisional Patent Application entitled "SELF-LOCK MODULE," assigned U.S. Ser. No. 61/983,526, filed Apr. 24, 2014, and which is incorporated herein by reference for all purposes.

FIELD OF THE SUBJECT MATTER

The presently disclosed subject matter relates to locks. More particularly, the presently disclosed subject matter relates to apparatus and corresponding methodology for association with keyed or non-keyed, mechanical or electromechanical locks in applications where it is desirable to have a preexisting lock which, upon closure of an associated drawer or door, automatically relocks itself.

BACKGROUND OF THE SUBJECT MATTER

In certain applications it is desirable to have a lock which automatically closes itself upon shutting of an associated door, or drawer, or other securing component.

In the context of a cam locking component or mechanism, it would be particularly desirable to have such a self-locking feature in combination with a slam-latching cam to aid in elimination of the risk otherwise occurring of damage to the associated lock or furniture (or similar component) due to forcible contact with a fixed cam.

Various patent document publications relate to lock subject matter, including cam locks and/or slam locks. For example, U.S. Pat. No. 8,403,376 is entitled "Convertible Motorized Latch" and Published US Patent Application Publication No. 2009/0315342 is entitled "Adjustable Cam for Cam Lock." Other examples include U.S. Pat. Nos. 8,234,891; 6,513,357; 6,474,118; 6,038,898; US Patent Application Publication No, 2013/0192320; US Patent Application Publication No. 2012/0248794; US Patent Application Publication No. 2011/0074543; US Patent Application Publication No. 2009/0132090; and US Patent Application Publication No. 2007/0257773. All of the foregoing examples are commonly owned with the subject application, and the complete disclosures of all such patent document publications are fully incorporated herein by reference, and for all purposes.

While various implementations of locks and retrofit modules have been developed, no design has emerged that generally encompasses all of the desired characteristics as hereafter presented in accordance with the presently disclosed technology.

SUMMARY OF THE SUBJECT MATTER

In view of the recognized features encountered in the prior art and addressed by the presently disclosed subject matter, improved apparatus and corresponding methodology therefor have been provided for improved lock closures. More particularly, the presently disclosed subject matter relates to keyed or non-keyed, mechanical or electromechanical locks for automatic relocking upon closure of the associated drawer or door (collectively referenced as an associated enclosure).

One presently disclosed exemplary embodiment relates to a self-locking module, for use with a preexisting lock and otherwise aiding in elimination of the risk of damage occurring to the associated lock or furniture (or similar component) due to forcible contact with a fixed cam.

In other presently disclosed aspects, a self-contained or self-locking module automatically rotates an associated existing lock back to a locked position thereof when an operator or user lets go of an associated key or knob, and when used in combination with a preexisting cam locking feature.

In other present aspects, disclosed are apparatus and corresponding methodology for the attachment of a self-contained module to any mechanical lock having a mating feature to accept it (in either of an OEM application or as a retrofit). The module enables separate (preexisting) cam locking feature (components) to be associated with an existing mechanical lock by being fitted onto the back of the existing lock and then having the cam locking components attached to the module. In turn, the preexisting cam locking components may be fitted to the module aligned in any one of four positions (up, down, left, and right) on the back of the module for latching in any position in which the associated lock/cam strike may be installed. The cam locking components then function to allow a user to open an associated door or drawer, and when finished, slam it shut without having to rotate the lock back to a locked position. The self-contained module allows the cam locking components to be fitted to a standard, mechanical lock and still have the self-lock feature that is otherwise not available within the existing lock.

One present disclosed exemplary embodiment relates to a self-contained module for interfacing with a preexisting lock rotatable by a user from a locked to an unlocked position thereof, for providing a self-locking function to such preexisting lock. Such a module preferably comprises an outer housing; a rotatable inner axle received within such outer housing, and having an engagement feature for interfacing with a preexisting lock so that such inner axle and the preexisting lock are rotationally locked to one another; and a torsion spring situated between and associated with such outer housing and such inner axle so that rotation of such inner axle within such outer housing by rotation of the preexisting lock by a user to an unlocked position thereof causes storage of torsional energy in such spring. Per the subject arrangement, such torsional energy causes the preexisting lock to automatically return to a locked position thereof whenever released by a user of the preexisting lock.

In a variation of such self-contained module, such inner axle engagement feature may comprise a recessed drive feature for mating with a corresponding drive feature of the preexisting lock. In some such variations, such inner axle may further include a protruding drive feature for rotationally locking such inner axle with a preexisting cam locking component mated therewith so that the preexisting cam locking component is actuated whenever the preexisting lock is returned to a locked position thereof. Additionally, for some such variations, the preexisting cam locking component may comprise a slam-latching cam.

In other presently disclosed alternatives of an exemplary self-contained module, such torsion spring may have respective ends thereof which are affixed to such outer housing and such inner axle, respectively.

Yet for other alternative self-contained module embodiments, such outer housing may comprise an annular shape and further include at least one axially protruding alignment tab for engaging selected portions of a preexisting lock.

Still other variations may include a securing screw for selectively securing such self-contained module with a preexisting lock and a preexisting cam locking component, and a retaining ring for securing such inner axle within such other housing.

Some alternatives may also include cooperating tab and slot features which limit rotation of a mated preexisting cam locking component through a predetermined angle.

Yet another presently disclosed exemplary embodiment may relate to a self-locking combination. Such combination preferably comprises a preexisting lock rotatable by a user from a locked to an unlocked position thereof; a preexisting slam-latching cam locking component; and a self-contained module. Such module preferably has an outer housing; a rotatable inner axle received within such outer housing and having a plurality of engagement features for respectively interfacing with such preexisting lock and cam locking component so that such inner axle and such preexisting lock and cam locking component are rotationally locked to one another; and a torsion spring situated between and associated with such outer housing and such inner axle. With such arrangement, preferably rotation of such inner axle within such outer housing by rotation of such preexisting lock by a user to an unlocked position thereof causes storage of torsional energy in such spring, which torsional energy causes such preexisting lock to automatically return to a locked position thereof and causes actuation of such cam locking component whenever such preexisting lock is released by a user.

Some such self-locking combinations may further include a retaining ring for axially securing such inner axle within such outer housing; and a securing screw for selectively securing such self-contained module with such preexisting lock and such preexisting cam locking component. With such configurations, such torsion spring is seated within such outer housing with such inner axle positioned within the center of such spring, and such torsion spring has respective ends thereof which are affixed to such outer housing and such inner axle, respectively. In other variations of such self-locking combinations, such inner axle engagement features respectively may comprise a recessed drive feature for mating with a corresponding drive feature of such preexisting lock, and a protruding drive feature for rotationally locking such inner axle with a preexisting cam locking component mated therewith.

For yet other variations, such preexisting lock comprises a cylinder lock having opposing flat side portions; and such outer housing comprises a matching annular shape and further includes axially protruding alignment tabs for engaging such preexisting lock opposing flat side portions; while such self-contained module may further include cooperating tab and slot features which limit rotation of such preexisting cam locking component through a predetermined angle.

In some presently disclosed alternative self-locking combinations, such preexisting slam-latching cam locking component is locked to such self-contained module in a selective position thereof relative to an associated lock/cam strike of such cam locking component, for closure of an associated enclosure. In other variations, such preexisting lock may comprise one of a keyed or non-keyed, and mechanical or electromechanical locks for automatic relocking thereof upon closure of an associated enclosure.

For some alternatives, a self-locking combination may further include a retaining ring for axially securing such inner axle within such outer housing; and a securing screw for selectively securing such self-contained module with such preexisting lock and such preexisting cam locking component; wherein such torsion spring may be seated within such outer housing with such inner axle positioned within the center of such spring, and such torsion spring may have respective ends thereof which are affixed to such outer housing and such inner axle, respectively; such inner axle engagement features may respectively comprise a recessed drive feature for mating with a corresponding drive feature of such preexisting lock, and a protruding drive feature for rotationally locking such inner axle with a preexisting cam locking component mated therewith; such preexisting lock may comprise a cylinder lock having opposing flat side portions; such outer housing may comprise a matching annular shape and may further include axially protruding alignment tabs for engaging such preexisting lock opposing flat side portions; and such self-contained module may further include cooperating tab and slot features which limit rotation of such preexisting cam locking component through a predetermined angle.

Those of ordinary skill in the art should appreciate and understand from the complete disclosure herewith that the presently disclosed subject matter equally relates to corresponding and associated methodology. One exemplary embodiment of methodology for providing a self-locking function to a preexisting lock of the type rotatable by a user from a locked to an unlocked position thereof, may comprise providing a self-contained module having an outer housing, a rotatable inner axle received within such outer housing and having an engagement feature for interfacing with a preexisting lock, and a torsion spring situated between and associated with such outer housing and such inner axle; and interfacing such module with a preexisting lock so that such inner axle and the preexisting lock are rotationally locked to one another. Per practice of such methodology, rotation of such inner axle within such outer housing by rotation of the preexisting lock by a user to an unlocked position thereof causes storage of torsional energy in such spring, which torsional energy causes such preexisting lock to automatically return to a locked position thereof whenever such preexisting lock is released by a user. Therefore, use of such module allows a preexisting lock to be retrofitted with such self-lock feature otherwise not available with such preexisting lock.

Variations of such exemplary methodology may further include providing such self-contained module inner axle with a further engagement feature for interfacing with a preexisting slam-latching cam locking component; and interfacing such module with a preexisting cam locking component so that such inner axle and such preexisting lock and cam locking component are rotationally locked to one another. With such methodology, such cam locking component is actuated whenever such preexisting lock is released by a user, whereby use of such module allows a user to open an associated enclosure, and when finished, slam such enclosure shut without having to separately rotate the preexisting lock back to a locked position. Some of such variations may further include axially securing such inner axle within such outer housing; selectively securing such module with a preexisting lock and a preexisting cam locking component; and seating such torsion spring within such outer housing with such inner axle positioned within the center of such spring, and affixing respective ends of such torsion spring to such outer housing and such inner axle, respectively.

Other alternative methodologies herewith may further include securing such module to a preexisting cam locking component in a selected position thereof relative to an associated lock/cam strike of such cam locking component, for closure of an associated enclosure. Still further, for other present alternatives, interfacing such module with a preexisting lock may include interfacing such module with any one of a keyed, non-keyed, mechanical, and electromechanical lock for automatic relocking thereof.

Additional objects and advantages of the presently disclosed subject matter are set forth in, or will be apparent to those of ordinary skill in the art from, the detailed description herein. Also, it should be further appreciated that modifications and variations to the specifically illustrated, referenced, and discussed features, elements, and steps hereof may be practiced in various embodiments and uses of the presently disclosed subject matter without departing from the spirit and scope of the subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the presently disclosed subject matter may include various combinations or configurations of presently disclosed features, steps, or elements, or their equivalents (including combinations of features, parts, or steps or configurations thereof not expressly shown in the figures or stated in the detailed description of such figures). Additional embodiments of the presently disclosed subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification.

BRIEF DESCRIPTION OF THE DRAWINGS

A full and enabling disclosure of the presently disclosed subject matter, including the best mode thereof, directed to one of ordinary skill in the art, is set forth in the specification, which makes reference to the appended figures, in which.

Figure 1:
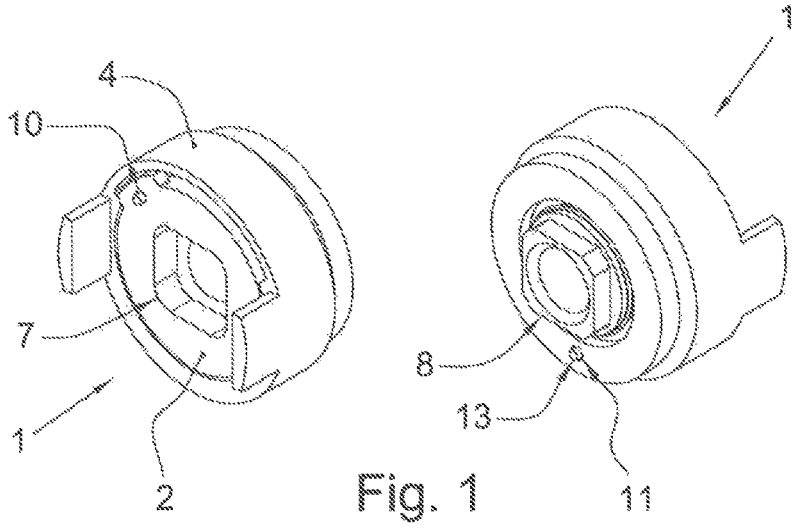
FIG. 1 illustrates front and back perspective views of an exemplary self-lock module embodiment in an assembled state thereof, in accordance with presently disclosed subject matter technology.

Repeat use of reference characters throughout the present specification and appended drawings is intended to represent same or analogous features, elements, or steps of the presently disclosed subject matter.

DETAILED DESCRIPTION OF THE PREFERRED EMBODIMENTS

As discussed in the Summary of the Subject Matter section, the presently disclosed subject matter is generally concerned with apparatus and methodologies for improved lock closures. More particularly, the presently disclosed subject matter relates to keyed or non-keyed, mechanical or electromechanical locks for automatic relocking upon closure of the associated drawer or door, with one presently disclosed exemplary embodiment relating to a self-locking module, for use with a preexisting lock.

Selected combinations of aspects of the presently disclosed technology correspond to a plurality of different embodiments of the presently disclosed subject matter. It should be noted that each of the exemplary embodiments presented and discussed herein should not insinuate limitations of the presently disclosed subject matter. Features or steps illustrated or described as part of one embodiment may be used in combination with aspects of one or more other embodiments to yield yet further embodiments. Additionally, certain features may be interchanged with similar devices or features not expressly mentioned which perform the same or similar function or functions.

Reference will now be made in detail to the presently preferred embodiments of the subject self-locking module apparatus and methodology.

A typical illustration of an exemplary embodiment of the presently disclosed subject matter as ready to be installed in the field is represented by application FIG. 1. Such exemplary embodiment of the presently disclosed subject matter is preferably comprised of a self-contained module that allows a preexisting cam lock component to be attached to any mechanical lock having a mating feature to accept it. Such combination includes OEM (Original Equipment Manufacturer) applications or as a retrofit in the field. The presently disclosed module per present methodology may be fitted onto the back of a suitable preexisting lock, with the cam locking component features then attached to such module.

As will be understood by those of ordinary skill in the art, such cam locking features may per present disclosure be aligned in any one of four positions (up, down, left, and right) on the back of the subject module for latching in any position in which the associated lock/strike may be installed. The function of the cam locking feature is to allow the user to open a door or drawer, and when done, slam it shut without having to rotate the associated lock back to a locked position. The module allows such a cam locking feature to be fitted to a standard, mechanical lock and still have the self-lock feature that is otherwise not available within the associated preexisting lock.

Thus, disclosed herewith are apparatus and corresponding methodology for the attachment of a self-contained module to any mechanical lock having a mating feature to accept it.

Figure 2:
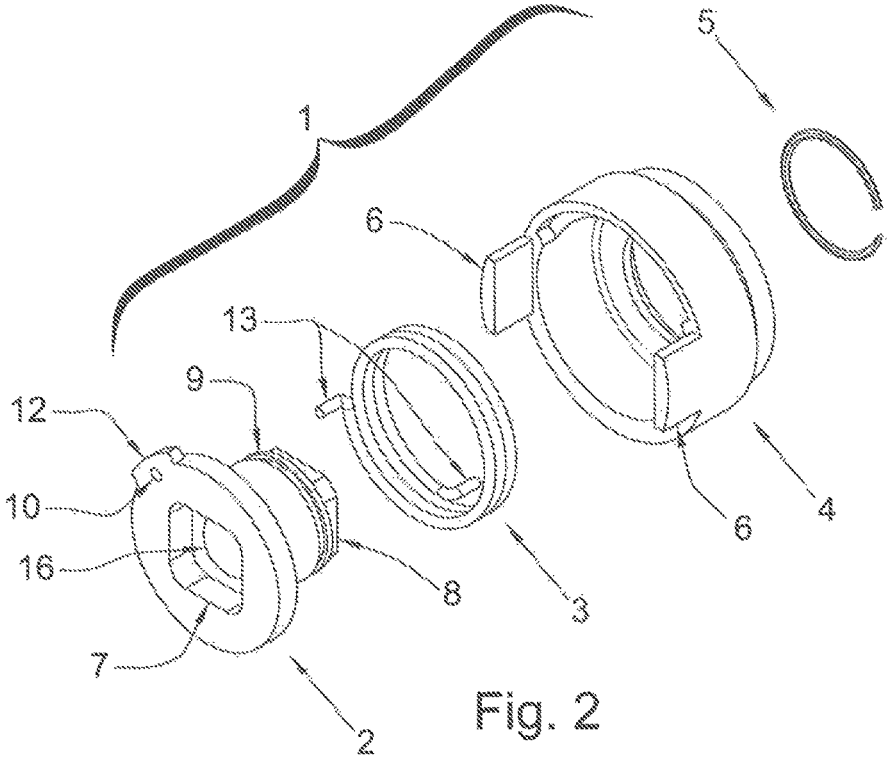
FIG. 2 illustrates a generally front perspective exploded view of the exemplary self-lock module embodiment of present FIG. 1.

FIG. 1 illustrates front and back perspective views of an exemplary self-lock module embodiment in an assembled state thereof, in accordance with presently disclosed subject matter technology, while FIG. 2 illustrates a generally back perspective exploded view of such exemplary self-lock module embodiment of present FIG. 1. The exploded view of FIG. 2 reflects that such presently disclosed module 1 includes an inner axle 2, torsion spring 3, outer housing 4, and a retaining ring 5.

As shown, the exemplary self-lock module 1 has a depressed (recessed) square drive feature 7 and a raised square drive feature 8 in an inner axle portion 2 thereof. The legs 13 of a torsion spring 3 (FIG. 2) are affixed in holes 10 and 11 in the inner axle 2 and outer housing 4, respectively. With such an arrangement, rotation of inner axle 2 within outer housing 4 will cause the storage of torsional energy in spring 3.

Figure 3:
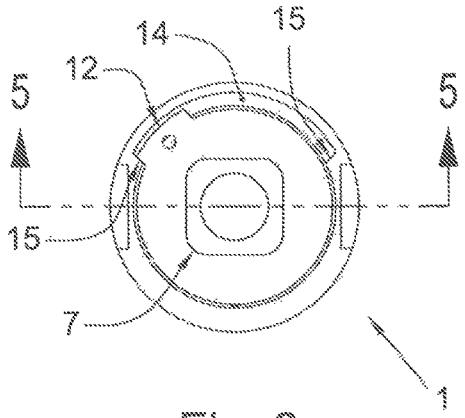
FIGS. 3 and 4 are front and side elevational views, respectively, of the exemplary self-lock module embodiment of present FIG. 1, illustrating an engagement feature thereof for interfacing with an existing lock.
Figure 4:
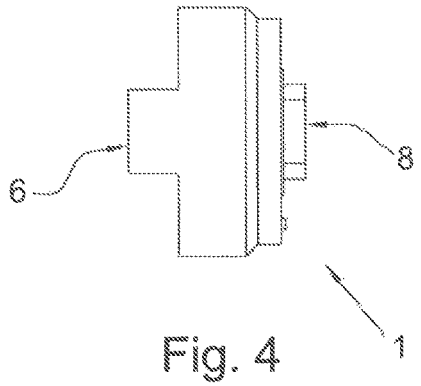

FIGS. 3 and 4 are front and side elevational views, respectively, of the exemplary self-lock module embodiment of present FIG. 1. More particularly, the FIG. 3 front elevational view of module 1 shows the square feature for mating with a preexisting lock, and shows the tab and slot features which allow a preexisting cam locking component to rotate through a predetermined angle. At the same time, the side elevational view of FIG. 4 shows the alignment tab on the front of module 1 which mates with the flats on the two sides of a preexisting lock, and shows the square feature on the back which mates with the preexisting cam locking component.

The front view of FIG. 3 illustrates the depressed (recessed) square drive feature 7, which is located centrally on inner axle 2. A tab 12 of such inner axle 2 is positioned inside of a slot 14 with stops 15 on either end of the slot, in the outer housing 4, to define a predetermined angle for the rotation of the inner axle 2 within the outer housing 4, which in turn will transfer the rotational movement to the cam attached on the back of the module 1, as otherwise discussed in further detail herein.

The FIG. 4 side elevational view shows a tab 6 in the outer housing 4 and the protruding square drive feature 8 in the inner axle 2. The function of the tab 6 is discussed in further detail herein. As will be understood by those of ordinary skill in the art, torsion spring 3 is seated within outer housing 4, and inner axle 2 is positioned within the center of spring 3.

Figure 5:
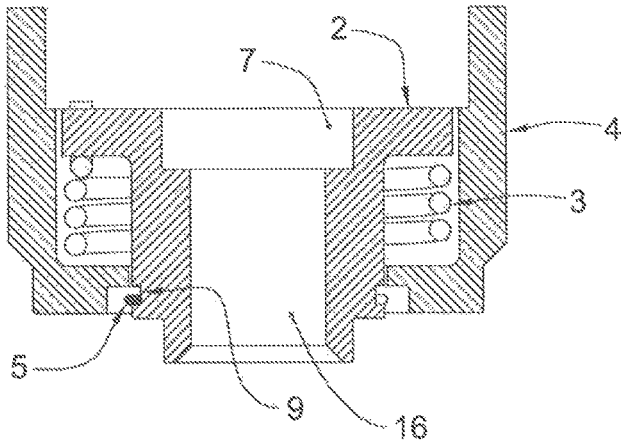
FIG. 5 is a sectional view taken along section line 5-5 in present FIG. 3, and representing internal components and features of the subject exemplary self-lock module in an assembled state thereof.

FIG. 5 is a sectional view taken along section line 5-5 in present FIG. 3, and representing internal components and features of the subject exemplary self-lock module in an assembled state thereof. As represented, inner axle 2 is retained inside outer housing 4 with a retaining clip 5, and legs 13 (FIG. 2) of spring 3 are fixed within holes 10 and 11 in the inner axle 2 and outer housing 4 respectively, as otherwise discussed herein and as illustrated in FIG. 7.

Figure 6:
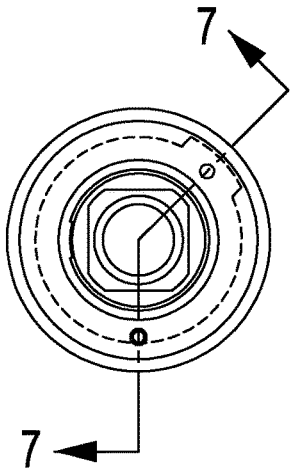
FIG. 6 is a rear elevational view of the exemplary self-lock module embodiment of present FIG. 1.
Figure 7:
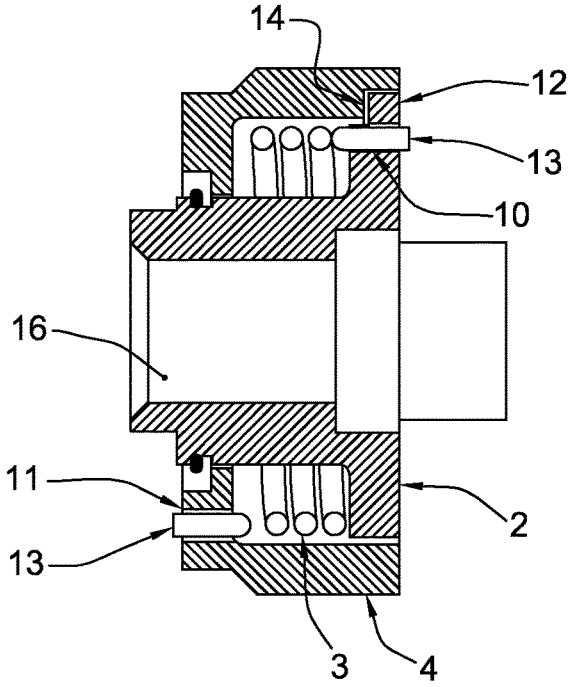
FIG. 7 is an aligned sectional view taken along section line 7-7 in present FIG. 6, representing internal components and features of the subject exemplary self-lock module in an assembled state thereof; and representing torsion spring engagement with an outer housing and inner axle, and tab engagement with a slot in the outer housing, for controlling rotational angle.

FIG. 6 is a rear elevational view of the exemplary self-lock module embodiment of present FIG. 1, while FIG. 7 is an aligned sectional view taken along section line 7-7 in present FIG. 6. FIG. 7 represents internal components and features of the subject exemplary self-lock module in an assembled state thereof, and represents torsion spring engagement with an outer housing, and tab engagement with a slot in the outer housing, for controlling rotational angle.

More particularly, FIG. 7 further shows one leg 13 of spring 3 affixed in the hole 11 in outer housing 4, and another leg 13 of spring 3 affixed in the hole 10 in inner axle 2. Tab 12 of inner axle 2 is positioned inside the slot 14 in the outer housing 4.

Figure 8:
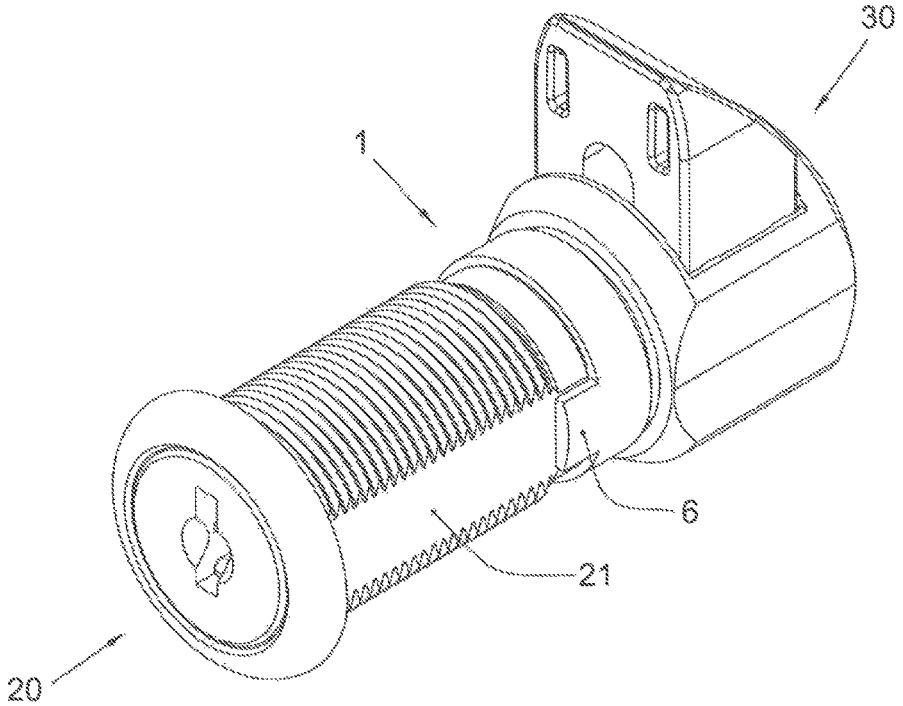
FIG. 8 is a representative combination view in perspective of the subject exemplary self-lock module in association with a representative view of a preexisting lock and preexisting cam locking components.

FIG. 8 is a representative combination view in perspective of the subject exemplary self-lock module (generally 1) in association with a representative view of a preexisting lock (generally 20) and preexisting slam—latching cam (generally 30). FIG. 8 shows such representative preexisting lock 20, the presently disclosed module generally 1 installed on the back of such preexisting lock 20, and a preexisting slam-latching cam or feature 30 installed on the back of such module 1.

Figure 9:
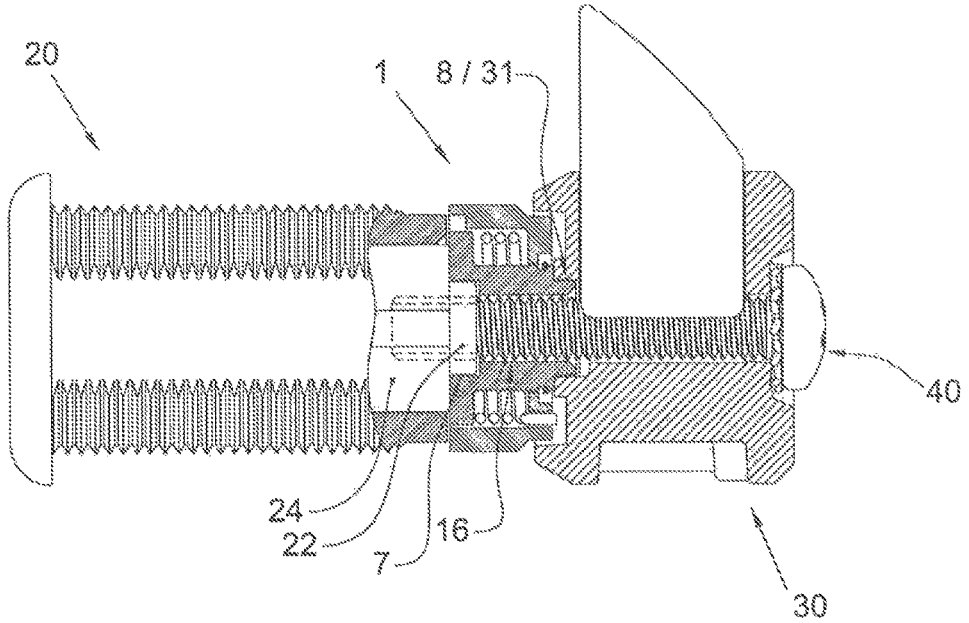
FIG. 9 is a partial longitudinal sectional view of the combination of present FIG. 8, representing the association of presently disclosed and preexisting components, held together such as by a screw.

FIG. 9 is a partial longitudinal sectional view of the exemplary combination illustrated in present FIG. 8, representing the association of presently disclosed and preexisting components, held together such as by a screw 40.

Figure 10:
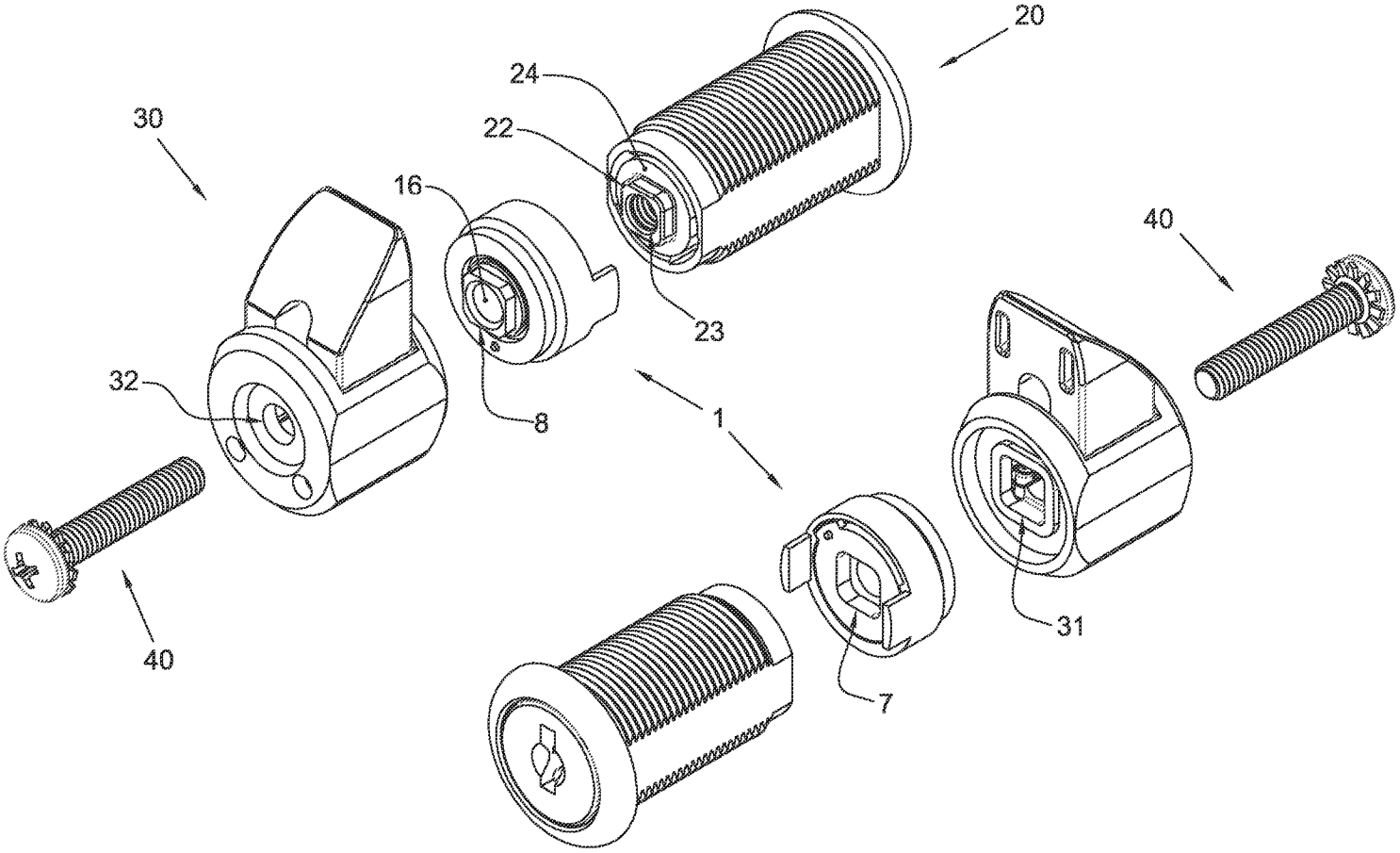
FIG. 10 illustrates front and back perspective exploded views, respectively, of the associated subject matter of present FIG. 8.

FIG. 10 illustrates front and back perspective exploded views, respectively, of the associated subject matter of present FIG. 8. Thus, considered another way, and in accordance with presently disclosed methodology, module 1 may be installed on the back of a lock 20, having a square drive feature 22, which mates with the depressed square drive feature 7 in the front of the inner axle 2, as shown in FIGS. 8, 9 and 10.

Furthermore, the protruding square drive feature 8 in the inner axle 2 mates with a square drive feature 31 of slam-latching cam 30. Assembly of such preexisting lock, presently disclosed module, and preexisting cam locking component may be preferably secured together such as with screw 40, which passes through a hole 32 in slam-latching cam 30, and through a hole 16 in inner axle 2, and fastens to the threaded hole 23 in the plug/inner bushing 24 of the lock 20. The lock plug/inner bushing 24, inner axle 2, and slam-latching cam 30 are rotationally locked to one another, transferring the motion from the key, in this embodiment, or a knob in another possible embodiment, to the slam-latching cam 30.

Additionally, tabs 6 in outer housing 4 rotationally lock the outer housing to the flats 21 in the lock's cylinder. While the outer housing 4 is stationary, the inner axle 2 can be rotated, thereby transferring torsional energy to the spring 3 when the lock 20 is turned to the open position. The torsional energy in the spring is stored until such time when the user lets go of the key or knob, at which time the torsional energy is released and the inner axle 2 is rotated back to the closed position, rotating the plug/inner bushing 24, and the slam-latching cam 30 along with it.

While the presently disclosed subject matter has been described in detail with respect to specific embodiments thereof, it will be appreciated that those skilled in the art, upon attaining an understanding of the foregoing, may readily produce alterations to, variations of, and/or equivalents to such embodiments. For example, in some embodiments, in place of using a retaining ring for securing the inner axle within the outer housing, a snap feature may be used in the outer housing and inner axle as another embodiment, or any other available securing means of holding the parts together may be used while the module is not assembled to a lock and cam. Accordingly, the scope of the present disclosure is by way of example rather than by way of limitation, and the subject disclosure does not preclude inclusion of such modifications, variations, and/or additions to the presently disclosed subject matter as would be readily apparent to one of ordinary skill in the art.

What is claimed is:

1. A self-contained module for interfacing with a preexisting lock rotatable by a user from a locked to an unlocked position thereof, for providing a self-locking function to such preexisting lock, said module comprising:

an outer housing;

a rotatable inner axle received within said outer housing, and having an engagement feature for interfacing with a preexisting lock so that said inner axle and the preexisting lock are rotationally locked to one another;

a retaining ring for securing said inner axle within said outer housing; and a torsion spring situated between and associated with said outer housing and said inner axle so that rotation of said inner axle within said outer housing by rotation of the preexisting lock by a user to an unlocked position thereof causes storage of torsional energy in said spring, which torsional energy causes the preexisting lock to automatically return to a locked position thereof whenever released by a user of the preexisting lock; and wherein said torsion spring has respective ends thereof which are affixed to said outer housing and said inner axle, respectively.

2. A self-contained module as in claim 1, wherein said inner axle engagement feature comprises a recessed drive feature for mating with a corresponding drive feature of the preexisting lock.

3. A self-contained module as in claim 2, wherein said inner axle further includes a protruding drive feature for rotationally locking said inner axle with a preexisting cam locking component mated therewith so that the preexisting cam locking component is actuated whenever the preexisting lock is returned to a locked position thereof.

4. A self-contained module as in claim 3, wherein the preexisting cam locking component comprises a slam-latching cam.

5. A self-contained module as in claim 3, further including a securing screw for selectively securing said self-contained module with a preexisting lock and a preexisting cam locking component.

6. A self-contained module as in claim 3, wherein said self-contained module further includes cooperating tab and slot features which limit rotation of a mated preexisting cam locking component through a predetermined angle.

7. A self-contained module as in claim 1, wherein said outer housing comprises an annular shape and further includes at least one axially protruding alignment tab for engaging selected portions of a preexisting lock.

8. A self-locking combination, comprising:

a preexisting lock rotatable by a user from a locked to an unlocked position thereof;

a preexisting slam-latching cam locking component; and a self-contained module having an outer housing; a rotatable inner axle received within said outer housing and having a plurality of engagement features for respectively interfacing with said preexisting lock and cam locking component so that said inner axle and said preexisting lock and cam locking component are rotationally locked to one another; and a torsion spring situated between and associated with said outer housing and said inner axle;

wherein, rotation of said inner axle within said outer housing by rotation of said preexisting lock by a user to an unlocked position thereof causes storage of torsional energy in said spring, which torsional energy causes said preexisting lock to automatically return to a locked position thereof and causes actuation of said cam locking component whenever said preexisting lock is released by a user; and wherein said torsion spring is seated within said outer housing with said inner axle positioned within the center of said spring, and said torsion spring has respective ends thereof which are affixed to said outer housing and said inner axle, respectively.

9. A self-locking combination as in claim 8, further including:

a retaining ring for axially securing said inner axle within said outer housing; and a securing screw for selectively securing said self-contained module with said preexisting lock and said preexisting cam locking component.

10. A self-locking combination as in claim 8, wherein said inner axle engagement features respectively comprise a recessed drive feature for mating with a corresponding drive feature of said preexisting lock, and a protruding drive feature for rotationally locking said inner axle with a preexisting cam locking component mated therewith.

11. A self-locking combination as in claim 8, wherein:

said preexisting lock comprises a cylinder lock having opposing flat side portions; and said outer housing comprises a matching annular shape and further includes axially protruding alignment tabs for engaging said preexisting lock opposing flat side portions;

wherein said self-contained module further includes cooperating tab and slot features which limit rotation of said preexisting cam locking component through a predetermined angle.

12. A self-locking combination as in claim 8, wherein said preexisting slam-latching cam locking component is locked to said self-contained module in a selective position thereof relative to an associated lock/cam strike of said cam locking component, for closure of an associated enclosure.

13. A self-locking combination as in claim 8, wherein said preexisting lock comprises one of a keyed or non-keyed, and mechanical or electromechanical locks for automatic relocking thereof upon closure of an associated enclosure.

14. A self-locking combination as in claim 8, further including:

a retaining ring for axially securing said inner axle within said outer housing; and a securing screw for selectively securing said self-contained module with said preexisting lock and said preexisting cam locking component;

said inner axle engagement features respectively comprise a recessed drive feature for mating with a corresponding drive feature of said preexisting lock, and a protruding drive feature for rotationally locking said inner axle with a preexisting cam locking component mated therewith;

said preexisting lock comprises a cylinder lock having opposing flat side portions;

said outer housing comprises a matching annular shape and further includes axially protruding alignment tabs for engaging said preexisting lock opposing flat side portions; and said self-contained module further includes cooperating tab and slot features which limit rotation of said preexisting cam locking component through a predetermined angle.

15. Methodology for providing a self-locking function to a preexisting lock of the type rotatable by a user from a locked to an unlocked position thereof, comprising:

providing a self-contained module having an outer housing, a rotatable inner axle received within such outer housing and having an engagement feature for interfacing with a preexisting lock, and a torsion spring situated between and associated with such outer housing and such inner axle; and interfacing such module with a preexisting lock so that such inner axle and the preexisting lock are rotationally locked to one another, and affixing respective ends of such torsion spring to such outer housing and such inner axle, respectively;

wherein, rotation of such inner axle within such outer housing by rotation of the preexisting lock by a user to an unlocked position thereof causes storage of torsional energy in such spring, which torsional energy causes such preexisting lock to automatically return to a locked position thereof whenever such preexisting lock is released by a user, whereby use of such module allows a preexisting lock to be retrofitted with such self-lock feature otherwise not available with such preexisting lock.

16. Methodology as in claim 15, further including:

providing such self-contained module inner axle with a further engagement feature for interfacing with a preexisting slam-latching cam locking component; and interfacing such module with a preexisting cam locking component so that said inner axle and said preexisting lock and cam locking component are rotationally locked to one another, so that such cam locking component is actuated whenever such preexisting lock is released by a user, whereby use of such module allows a user to open an associated enclosure, and when finished, slam such enclosure shut without having to separately rotate the preexisting lock back to a locked position.

17. Methodology as in claim 16, further including:

axially securing such inner axle within such outer housing;

selectively securing such module with a preexisting lock and a preexisting cam locking component; and seating such torsion spring within such outer housing with such inner axle positioned within the center of such spring.

18. Methodology as in claim 16, further including securing such module to a preexisting cam locking component in a selected position thereof relative to an associated lock/cam strike of said cam locking component, for closure of an associated enclosure.

19. Methodology as in claim 15, wherein interfacing such module with a preexisting lock includes interfacing such module with any one of a keyed, non-keyed, mechanical, and electromechanical lock for automatic relocking thereof.

* * * * *